US006983937B2

(12) United States Patent
Levinson

(10) Patent No.: US 6,983,937 B2
(45) Date of Patent: Jan. 10, 2006

(54) STRATEGY GAME WITH DYNAMIC PLAYING BOARD

(76) Inventor: Joel S. Levinson, 2919 W. Kristal Way, Phoenix, AZ (US) 85027

( * ) Notice: Subject to any disclaimer, the term of this patent is extended or adjusted under 35 U.S.C. 154(b) by 0 days.

(21) Appl. No.: 10/714,130

(22) Filed: Nov. 13, 2003

(65) Prior Publication Data

US 2005/0104291 A1 May 19, 2005

(51) Int. Cl.
*A63F 9/00* (2006.01)

(52) U.S. Cl. ..... 273/309; 273/248; 273/249; 273/275; 273/281; 273/282.3

(58) Field of Classification Search ..... 273/258, 273/248, 283, 284
See application file for complete search history.

(56) References Cited

U.S. PATENT DOCUMENTS

| | | | | | |
|---|---|---|---|---|---|
| 3,433,478 | A | * | 3/1969 | Span et al. | 273/443 |
| 3,511,504 | A | * | 5/1970 | Mann et al. | 273/244 |
| 3,550,943 | A | * | 12/1970 | Hatcher | 273/260 |
| 3,827,694 | A | * | 8/1974 | Lemelson | 273/113 |
| 4,229,006 | A | * | 10/1980 | Morse | 273/153 S |
| 4,346,889 | A | * | 8/1982 | Barlow et al. | 273/442 |
| 4,465,280 | A | * | 8/1984 | Dimitriu | 273/153 R |
| 4,465,283 | A | * | 8/1984 | Pilette et al. | 273/249 |
| 4,498,674 | A | * | 2/1985 | Ferris et al. | 273/243 |
| 4,682,777 | A | * | 7/1987 | Wood | 273/243 |
| 4,813,679 | A | * | 3/1989 | Hoffman | 273/248 |
| 5,018,743 | A | * | 5/1991 | Maier et al. | 273/242 |
| 5,464,224 | A | * | 11/1995 | Rosenbaum | 273/258 |
| 5,749,575 | A | * | 5/1998 | German | 273/113 |
| 6,065,750 | A | * | 5/2000 | Mattoon et al. | 273/249 |
| 6,742,780 | B1 | * | 6/2004 | Rudski | 273/109 |

* cited by examiner

*Primary Examiner*—Stephen Blau
*Assistant Examiner*—D Collins
(74) *Attorney, Agent, or Firm*—Howison & Arnott, L.L.P.

(57) ABSTRACT

A dynamic non-static game board is formed at the beginning of each game by the players each placing tiles having playing spaces which may have side walls. The walls create a maze configuration through which pieces move. To win, one must move all of one's pieces, 1–5 depending on difficulty level, from one side of the board and off the opposite side. A random number selection means such as dice indicates the number of spaces to be moved. On some turns at least one visual indicator for a "stack" move and another for side a "slide" move appear simultaneously with a number. A stack allows a player to stack a tile on top of an existing tile to alter the configuration of the maze. A slide allows a player to slide another tile into one end of one row, thus pushing an existing tile off the other end of the row and possibly altering the maze configuration. The strategy game may be programmed and displayed on a visual media such as a video game or on the world wide web.

20 Claims, 5 Drawing Sheets

STRATEGY GAME WITH DYNAMIC PLAYING BOARD

BACKGROUND OF THE INVENTION

1. Field of the Invention

The present invention relates to a strategic board game, and more particularly, to a game device and method for a game of chance and strategy involving the manipulating of a plurality of different directional tiles to create a dynamic non-static playing board in a changeable maze configuration, which is changeable during play and using specially marked random selection means such as dice to move playing pieces through the maze configuration and to alter the maze configuration.

2. Description of the Prior Art

Games of chance and strategy games have been popular throughout time. The excitement and challenge of the play and winning the game as well as the social interaction are a continual attraction to people of all ages.

Strategy board games often involve moving pieces on a board and some games involve setting up the movement structure of the board, but the prior art devices do not provide initial strategic structuring of the board as well as dynamic restructuring of the board in different ways to alter the movement paths and positions of pieces on the board.

Prior art U.S. Pat. No. 3,025,063, issued Mar. 13, 1962 to Magee, provides a game that requires both skill and chance. Each player selects the route of travel for his pawn and may also block off different paths in the network so as to prevent movement by any other pawn along such path beyond the block. The distance each players moves his pawn is determined by a chance device. The objective of the game is for the player to bring his pawn home before any other player.

Prior art U.S. Pat. No. 3,731,934, issued May 8, 1973 to Shoptaugh, shows a game board that has a series of sliders with spaces thereon for the playing pieces and also containing barrier elements. The sliders are mounted for lateral movement between home positions disposed at opposite sides of the board. Each slider has two rows of spaces and the barrier elements are arranged to separate adjacent spaces in one row and to separate a space in one row from the aligned space in the other row. The object of the game is for one player to move his playing piece from one side of the board to the other before his opponent.

Prior art U.S. Pat. No. 6,065,750, issued May 23, 2000 to Mattoon, claims a maze board game for providing an enjoying game for a number of players. The board game includes a base member and a generally transparent top member spaced above the base member. A middle board is interposed between the base member and the top member. The middle board is rotatably mounted to the base member. The middle board has a plurality of generally rectangular playing spaces arranged in a grid has a number of columns and a number of rows extending generally perpendicular to the columns. The playing spaces include a plurality of starting spaces, a plurality of barrier spaces, a plurality of exchange spaces, and a plurality of loss of turn spaces. The middle board also has a generally rectangular ending space.

Prior art U.S. Pat. No. 5,820,125, issued Oct. 13, 1998 to Olsen, describes a board game wherein a player must move a token through a plurality of playing fields and return to a starting position. Movement between playing fields is conditioned on the successful completion of a requirement such as correctly answering a question or collecting a plurality of tiles in a desired combination. The first player to pass through each of the playing fields and return to the starting position is declared the winner.

Prior art U.S. Pat. No. 5,607,159, issued Mar. 4, 1997 to Bryson, discloses a board game that comprises a game board, tokens and a random indicator which may be tiles or dice. The game board has a playing surface defined by a matrix of spaces, and the random indicator is used to direct the movement of the tokens across the surface. The tiles or dice each have faces thereon, wherein each face bears three types of indicia. One type of indicia indicates the direction of movement of the token, either forward or backward, the second type of indicia indicates the amount of movement of the token, and the third type of indicia indicates the axis of reference the token is supposed to move along.

Prior art U.S. Pat. No. 5,464,224, issued Nov. 7, 1995 to Rosenbaum, indicates a game board that includes a field defined by an array of playing spaces arranged in rows and columns on the field and a plurality of edge regions, wherein each edge region is disposed between a corresponding pair of adjacent playing spaces and wherein visually distinguishable first and second home positions are defined by two of the playing spaces. The game board further includes first and second visually distinguishable playing pieces and first and second sets of fence pieces. The fence pieces of the first set are visually distinguishable from fence pieces of the second set. The fences are stored in a bag from which they are randomly withdrawn during the game.

Prior art U.S. Pat. No. 5,333,878, issued Aug. 2, 1994 to Calhoun, puts forth a maze type board game that comprises a game board having a plurality of maze areas and segments interconnected between maze areas comprising a plurality of spaces. The spaces include: movement spaces, starting spaces and transport spaces, at,least one separate movable search piece for each player, and a plurality of maze walls for disposition on the game board, the spaces and maze walls having cooperative dimensions such that a plurality of maze walls are required to define a maze on the game board. The game is played in an attempt by one player to find the marked orb(s) hidden among decoy orb(s) of another player while the player, whose marked orb(s) is/are being searched for, places maze walls to delay or prevent other player(s) from finding the marked orb(s) thus forming a maze that must have at least one entrance and path leading to every marked orb in that maze area from the interconnected segments between the maze areas.

Prior art U.S. Pat. No. 4,817,957, issued Apr. 4, 1989 to Reeves, concerns a game played on a playing board that has a plurality of intersecting lateral and longitudinal grooves defining a grid of squares. A plurality of laterally and longitudinally oriented movable bars on the grid define a maze therewith. The movable bars are operatively connected to the grooves and respectively move laterally and longitudinally along the grooves. The movement of the bars changes the maze paths. Each bar has a width of one square and a length of three squares of the grid. The game apparatus also includes a plurality of playing pieces, objects for indicating random numbers of permissible movements of the playing pieces and the bars, and a surrounding frame to define the playing area and to retain the bars. Normally, an even number of players, such as two, attempt to move their playing pieces from opposite ends across the grid, end to end, the randomizing objects indicating the permissible number of squares across which the playing pieces can be moved and which laterally and/or longitudinally oriented bars can be shifted on the grid. The bars preferably include mechanical interfaces with the grooves of the grid which assure a stable position exactly covering a line of three adjacent squares.

Prior art U.S. Pat. No. 4,813,679, issued Mar. 21, 1989 to Hoffman, illustrates a strategy oriented board game wherein the board is divided into a plurality of elongated slidable strips. A first set of strips have intersections formed by first parallel lines intersecting second parallel lines. A second set of strips have similar intersections relatively offset from the intersections of the first set of strips. When the edges of the strips are aligned, the parallel lines are all connected forming linear intersecting pathways running diagonally across the face of the strips. Each player has a plurality of markers that are placed at home positions at opposite ends of the board. The markers are selectively movable across the strips along the pathways formed by the connection of the parallel lines. The objective is to move a player's marker to the opponent's home positions. According to the rules the strips may be slid, thereby re-positioning the markers located on the slid strip.

Prior art U.S. Pat. No. 4,465,280, issued Aug. 14, 1984 to Dimitriu, is for a maze game that includes individual pieces, that may be placed upon a game board, and markers that are moved along grooves formed in the upper surfaces of the individual pieces. The grooves of the individual pieces may be provided with gates extending across the grooves, the gates being pivotable within an intersection of grooves in a manner not determinable in advance by a moving player.

Prior art U.S. Pat. No. 4,252,320, issued Feb. 24, 1981 to Rouse, provides a board game apparatus for play by three players or groups of players which includes a game board bearing a substantially rectangular maze thereon. The maze is divided into a number of spaces or steps and includes a number of blocking positions. Residence strips are delineated or formed adjacent three sides of the maze. On the residence strips are delineated numbers of residence positions. Starting positions are delineated on the remaining fourth side of the maze. The play of the game is dictated by dice. A marker is placed on one of the residence positions on each of the three residence strips. This marker is designated a Residence. The object of the game is to move a marker or token from a starting position through the maze to visit the space directly in front of a Residence, a Doorstep. The dice also determine the opportunity for a player to place or move a blocking marker into a blocking position on the maze and thereby impede the movement of the other players token. Points or "Bugs" are scored by visiting the doorstep of all three Residence on the board in any order. Also included on the game board are blocking and scoring marker holding rows, a dice storage area, a visit-indicator, a Bug counter, and a token holding device.

Prior art U.S. patent application No. 20020089121, issued Jul. 11, 2002 to Bjornson, shows a rotating maze board game that includes a random chance unit, a plurality of game piece tokens, and a plurality of game board units wherein each of the game board units includes a generally flat rectangular game board segment having a playing surface provided with a plurality of interconnected pathways having both numbered squares and blank squares wherein the interconnected pathways further include connecting squares formed at the midpoint of all four sides of each game board segment, such that all of the game board segments, etc., may be rotated in any direction relative to one another during the course of the board game.

Prior art U.S. Pat. No. 4,552,363, issued Nov. 12, 1985 to Rehkemper, claims a game in which the players construct a three dimensional playing field during the course of play using pieces that include assigned tokens and common tiles. Each of the tiles is divided into a number of spaces such that each space is adapted to support either an assigned token or a portion of another tile with latter establishing a new level. A board provides a base surface with markings for the placement of the first level of tiles. Each of the tiles is constructed such that its upper surface can support other tiles or tokens. The tokens are supported by recesses located on the upper surface of the tiles. Other tiles are supported by intersecting slots located on the upper surface of the tiles. The game is won by the first player to place an assigned token atop a preselected level.

Prior art U.S. Pat. No. 4,850,595, issued Jul. 25, 1989 to Sherman, describes a method and apparatus for playing a competitive crossword puzzle game that includes a crossword puzzle that has individual word portions having associated definitions constituting clues for the solving of the individual word portions of the puzzle. Additional numerical indicia associated with each individual word portion representing the length of each word forming a word portion. Marking apparatus for filling in the individual word portions of the crossword puzzle in distinguishable characters. A die including numerical indicia on different ones of the sides of the die and with each indicia constituting the number of letters representing the length of the word to be used for filling in the individual word portions of the crossword puzzle. The players taking turns filing in the individual word portions of the crossword puzzle using the marking apparatus. Each turn for each player includes rolling the die to determine the length of the word to be filled in by the player. Each player during each individual turn matching the numerical indicia provided by the roll of the die with the additional numerical indicia and awarding points to each player based on the length of each word filled in correctly by each player during their respective turns.

Prior art U.S. Pat. No. 4,674,753, issued Jun. 23, 1987 to Hochstim, discloses a boardless maze game. The game is played on any suitable and substantially flat surface. Apparatus comprises a deck of 28 "L" shaped playing pieces, a deck holder for holding a deck of stacked playing pieces and a plurality of identifying markers. The playing pieces are marked with a heavy border to define a wall. The heavy border is interrupted in three places to define an exit. The playing pieces are marked on both sides, with one side being a mirror image of the other, so that the playing piece may be turned over and played on either side. A maze is constructed from the playing pieces, the maze being started by the placement of a first playing piece upon the playing surface by the first player in turn. The object of the game is to move a marker so as to escape from the maze through an exit as the construction of the maze continues. Rules are provided covering the playing of the game and include rules for team playing and match playing. The game also includes the occurrence or construction of "courtyards" and applicable rules are also provided therefor.

What is needed is a game of chance and strategy that provides maximum challenge and fun and infinite variety by being able to create and alter the structure of the board initially as well as during play to affect the direction and position of the pieces on the board while providing a chance roll of the dice or activation of another random number selection meansfor the number of moves of each piece which must be moved strategically through the board.

SUMMARY OF THE INVENTION

A primary object of the present invention is to create a game device and method for playing a game of chance and strategy that provides maximum challenge and fun and infinite variety by being able to create and alter a dynamic non-static playing board which may be placed upon a support board and/or rotatable support board separate from a table or other horizontal surface, the structure of the board initially as well as during play being configured and reconfigured by the players with tile pieces having playing spaces and possible barriers along at least one side of the playing space to create a configuration of a maze through which the pieces must move thereby altering the direction and position of the pieces on the board by dynamically changing the configuration of the maze during play, while providing a random selection means such as dice for the number of moves of each piece which must be moved strategically through the board.

Another object of the present invention is to provide random selection means such as dice, which in addition to determining the number of spaces a playing piece may be moved across the board, the random selection means such as dice also provide symbols for sliding a new tile into a row pushing out an existing tile at the opposite end of the row and for stacking a new tile onto an existing tile on the board, both sliding and stacking enabling the players to alter dynamically the configuration of the maze of the board during play thereby affecting the position of the pieces on the board and the direction in which pieces may move on the board.

A further added object of the present invention is to provide an underlying support board upon which to place the tile pieces to form the dynamic maze configuration, the board having means of aligning the tile pieces in rows and columns to form the dynamic maze.

One more object of the present invention is to provide a rotatable base upon which a game support board or the tile pieces may be placed to form the dynamic playing board in the configuration of a maze with the dynamic board capable of being turned on the rotatable base to face any desired orientation for each player in turn.

An additional object of the present invention is to entertain people of any age.

In brief, the game device and method of the present invention is played either on a table or a game board or on an electronic medium. Tiles are laid down at the beginning by the players alternating each laying down one tile at a time to make up a game board (each next to each other in rows). Each tile has one or more playing spaces forming a tile with any of a number of walls that are permenantly attached to the each tile on any side of any of the playing spaces, although there may be a tile without walls. The walls act together with the walls of other tiles to create directional paths over the tiled game board creating a mazelike environment through which playing pieces are moved. The game may be provided with any possible configuration of walls on each of the tiles.

The playing pieces that are moved over the tiled board are each uniquely configured with some visual demarcation to distinguish each player's piece from the other players' pieces. The pieces could be each uniquely shaped or uniquely colored or have other means for distinguishing each of the pieces. The pieces are positioned in the squares on the tiles and moved across the board through the mazelike environment without crossing any walls, moving one square for each number on the random selection, means such as dice.

The random selection means such as dice determining the number of spaces moved by a piece are uniquely configured with symbols, colors or other distinguishing means in addition to the numbers visible on the random selection means such as dice.

Each die or random number selection means has numbers, preferably 1, 2, 3 or 4. There are two #1's, two #2's, and one each of #3 and #4. Each die on one face also has a "slide" symbol (which may be a color such as orange) and on one other face a "stack" symbol (which may be a different color such as yellow). A player getting a random selection choice which includes a "slide" symbol is able to slide a new tile onto the board by sliding it into one row of the board and consequently sliding an existing tile off the opposite end of that row. A player getting a random selection choice which includes a "stack" symbol is able to add a new tile to the board by stacking the new tile on top of one of the existing tiles. Both the slide and the stack moves can alter the shape of the maze on the board. In addition to the slide or the stack move, the player also moves his or her playing piece across the board the number of squares indicated by the numbers in the random selection choice.

Each player in turn starts his or her playing pieces one at a time on the board on an entrance square at one edge of the board adjacent to the player. The first player to move his or her playing pieces across the board to an exit square and off the board on the opposite side is the winner.

The game may be played on an electronic device or played with actual pieces on any horizontal surface, but is preferably played on a pivotable board does such as on a lazy susan type of platform or a non-movable board with ridges to accommodate the tiles.

The game strategy involves creating and occasionally altering the maze configuration to create a clear path for a player's own pieces while trying to block a clear path for the opponents' pieces as well as moving a player's pieces across the board through the maze to reach the opposite side.

An advantage of the board game is that it enhances people's ability to quickly make decisions and change their minds dependent on obstacles presented to them as they play through the game.

Another advantage of the board game is that it provides entertainment for young children and adults.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
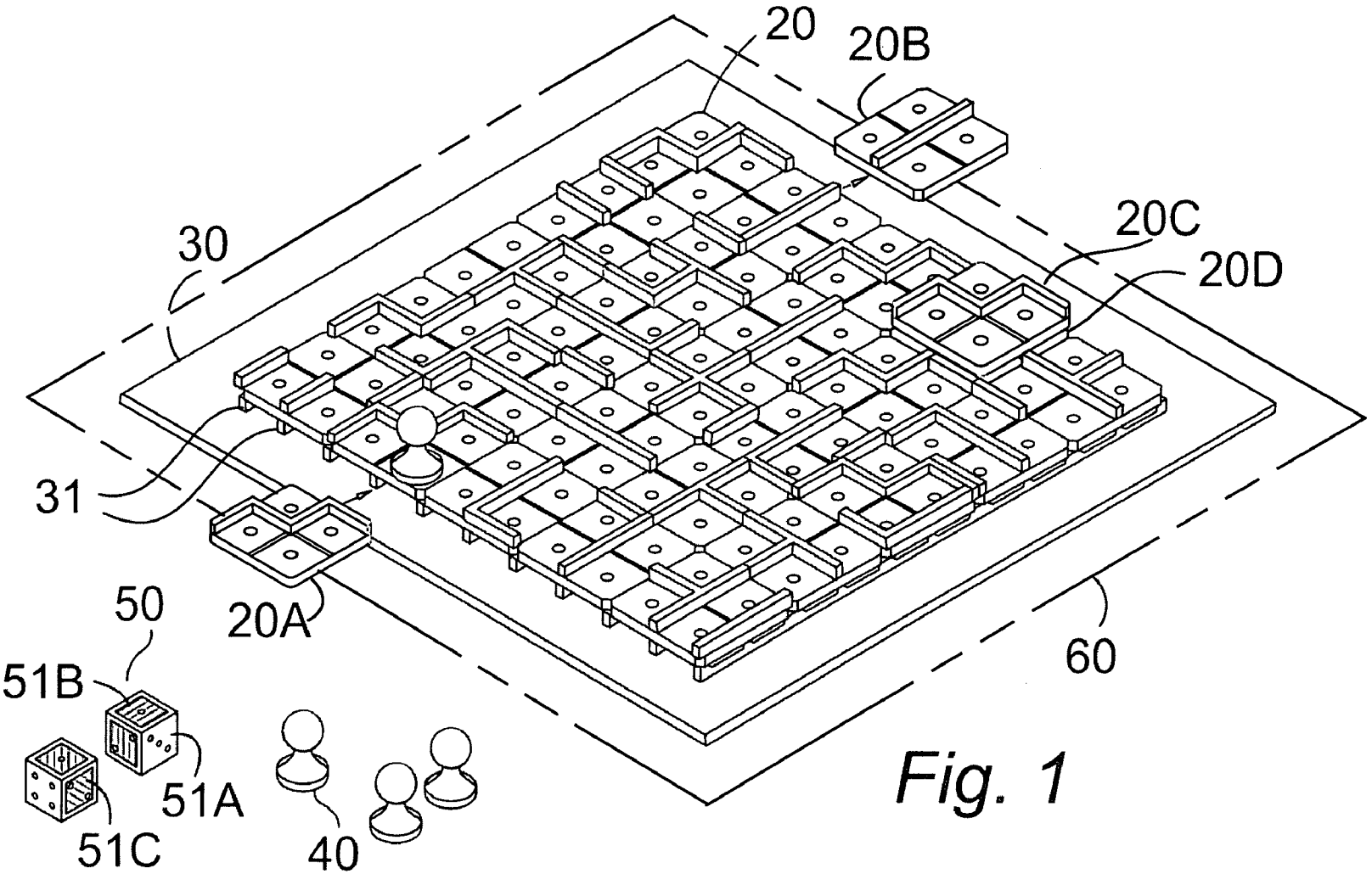
FIG. 1 is a perspective view of the game device of the present invention with the tiles all positioned in rows on the support board to form the maze of the playing board and showing a tile "slide" move and a tile "stack" move and the dice and some playing pieces.
Figure 2:
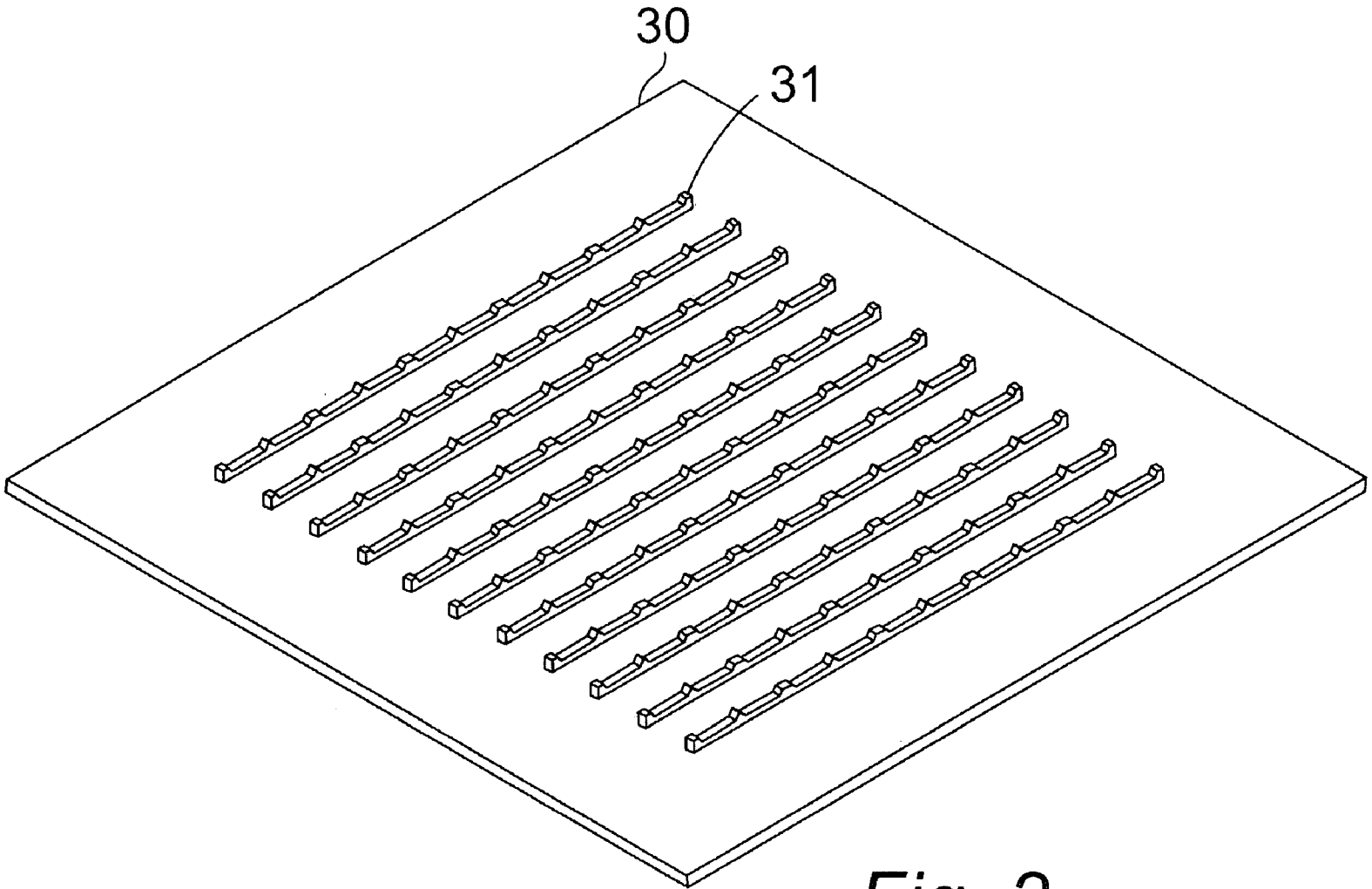
FIG. 2 is a perspective view of the support board of the game device of the present invention.
Figure 3:
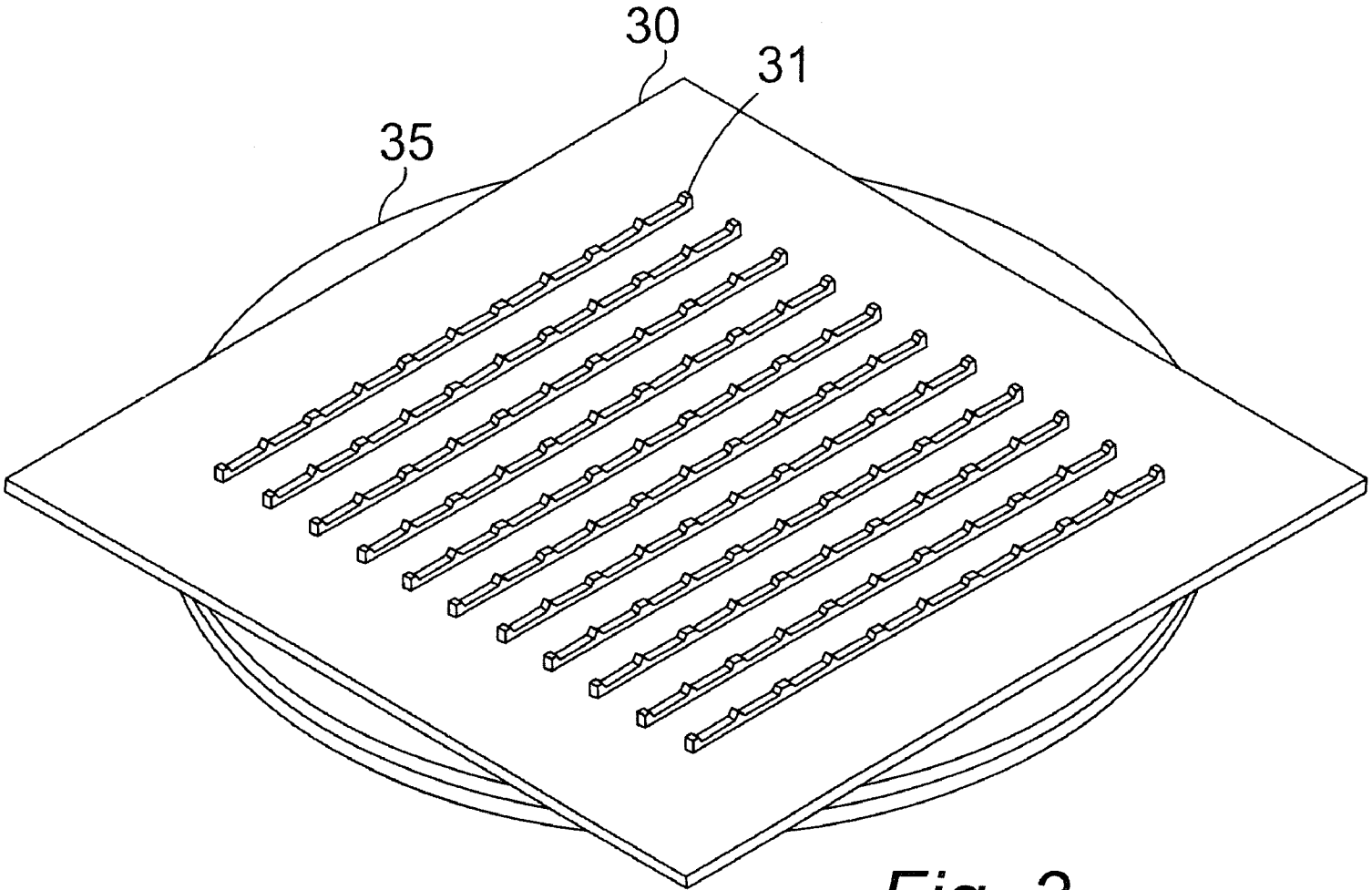
FIG. 3 is a perspective view of the support board of the game device of the present invention mounted on a lazy Susan type turning base.
Figure 4:
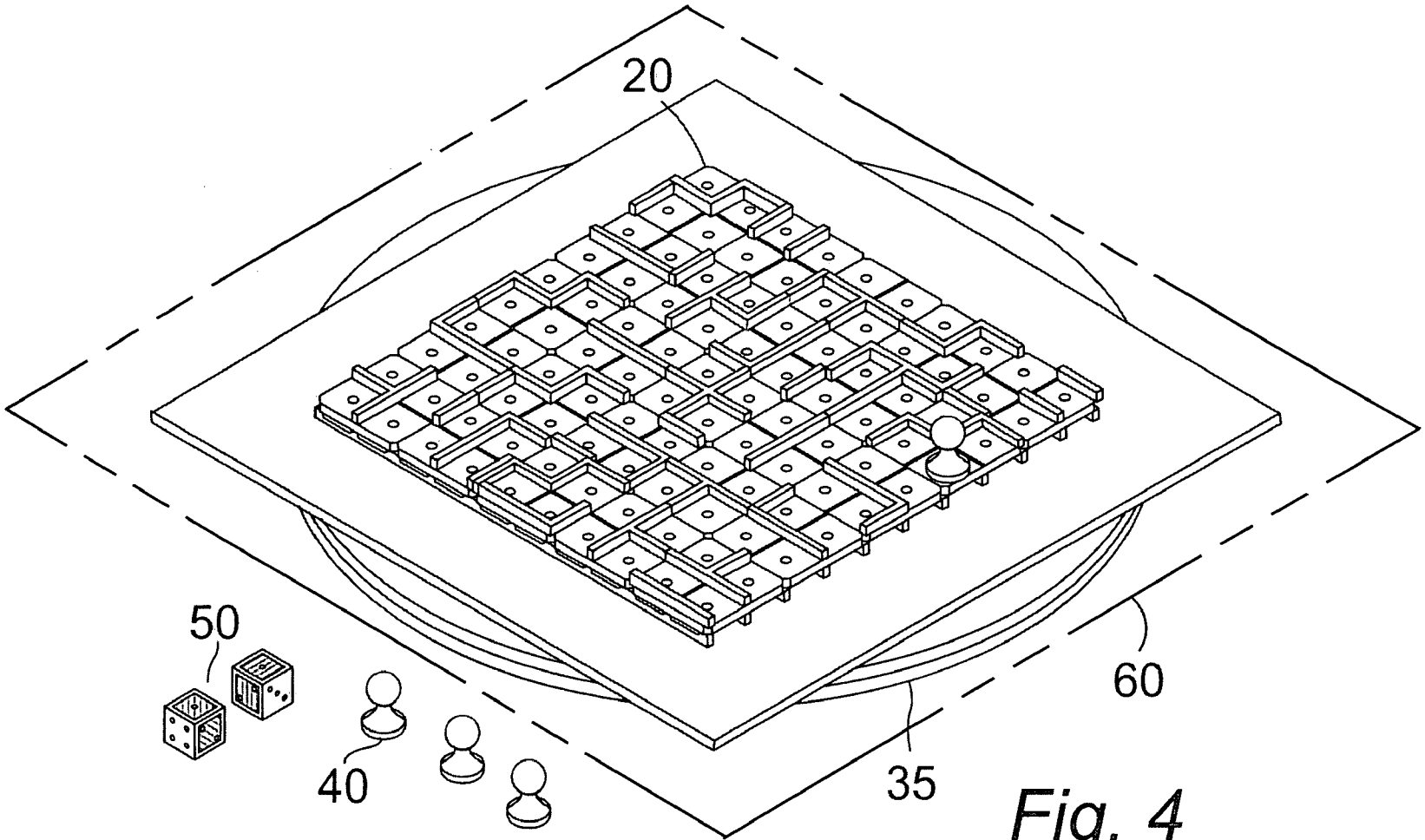
FIG. 4 is a perspective view of the game device of the present invention with the tiles all positioned in rows on the support board to form the maze of the playing board and the support board mounted on a lazy Susan type turning base.

In FIGS. 1–7, a strategy game is playable on an electronic medium with virtual game components or on a horizontal surface, such as a table top 60 as seen in FIGS. 1 and 4, with actual components. The strategy game comprises a series of playing pieces 40 with each piece having a distinguishing visual feature, such as color, for distinguishing the piece as exclusive to a player, a dynamic non-static playing board formed of tile pieces 20 having playing spaces 26 and barrier elements, such as walls 24, around the playing spaces, the tile pieces capable of being manipulated to create a dynamic non-static playing board in a changeable maze configuration, which maze configuration is changeable during play, the tile pieces positioned in rows by the players at the beginning of the game to form a maze, a random selection means such as dice to determine moves, and an optional support board 30 with elevated parallel ridges 31 on which to place the tiles to form rows. The dynamic playing board formed of the tile pieces 20 may be positioned either on the support board 30 or directly on a rotatable support 35, as seen in FIGS. 3 and 4 or directly on a table top 60 (FIGS. 1 and 4) or on the rotatable support 35 and the table top 60, as in FIG. 4.

In FIGS. 1, 4, 5 and 6, the series of tile pieces 20 and 20A–D, preferably each comprises four different possible playing spaces 26, which may be marked with a colored circle or dot or other indicator means in the center of each square playing space, for receiving at least one playing piece 40 thereon and possibly none, one, or more protruding walls 24 on one or more sides of the playing spaces indicating a barrier element across which a playing piece is not entitled to pass. The tile pieces 20 and 20A–D are capable of being evenly aligned in rows so that the pieces in each row are capable of sliding relative to an adjacent row, the tile pieces being capable of being positioned on any flat surface at a beginning of a game to form a dynamic non-static playing board with playing spaces and barrier elements creating a maze configuration, as seen in FIGS. 1 and 4, through which the playing pieces 40 are capable of moving and which dynamic playing board maze configuration may be altered during play.

The game board devise also includes at least one random selection means capable of indicating one of a series of numbers indicating a number of spaces to be moved across the playing board on the playing spaces by a playing piece, preferably a pair of dice 50 each having six sides with a number on each side 51A, preferably 1–4, indicating the number of playing spaces 26 across which a playing piece 40 may be moved in a given turn.

The random selection means, such as the dice 50, further comprises at least one "slide" indicator 51B, designated by a side of the dice that is color-coded or bearing other visible indicator to signify a "slide" move, randomly appearing on a player's turn which designates that the player slide a new tile piece, such as 20A in FIG. 1, into a first end of one row and thereby causing a tile piece, such as 20B, at an opposite second end of the row to slide out of the row and be removed from the playing board, thereby altering the maze configuration on the playing board and possibly moving a playing piece if there is one positioned in the row.

The random selection means or pair of dice 50 further comprises at least one "stack" indicator 51C, designated by a side of the dice that is color-coded in a different color from the "slide" color or bearing some other indicator to-signify a "stack" move, randomly appearing on a player's turn which designates that the player stack a new tile piece, such as stacked tile piece 20C in FIG. 1, on top of any other tile, such as playing tile 20D, on the board, again possibly altering the maze configuration by changing the wall configuration.

Figure 5:
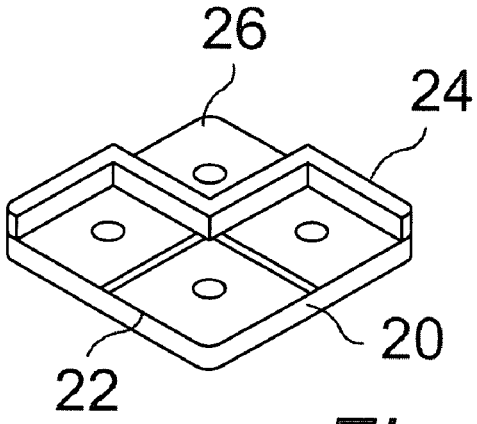
FIG. 5 is a perspective view of the top of a tile showing the playing squares and the sections of wall forming the maze.

Each of the tile pieces 20 has a top side 22, as seen in FIG. 5, preferably formed in a square plane comprising four separate square tiles 26, which may have a central circle or dot or other visual indicator, indicating at least one or more, preferably four, playing spaces evenly spaced around the tile piece 20 and at least one barrier indicator comprising none, one, or more walls 24 protruding from the top side around the sides of the playing spaces.

Figure 6:
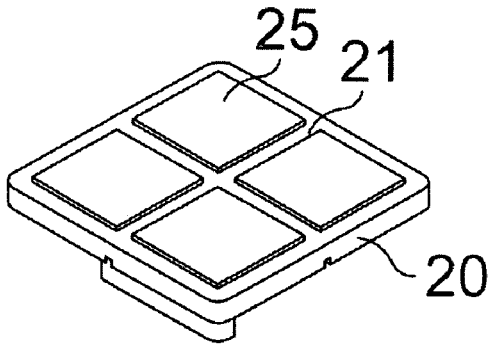
FIG. 6 is a perspective view of the bottom of a tile showing the cross-shaped groove enabling the tile to slide in any orientation in any row on the support board.
Figure 7:
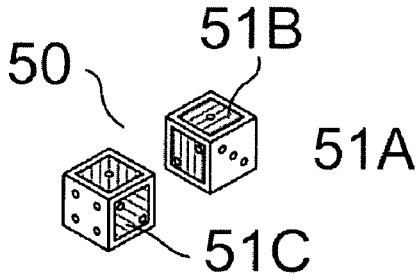
FIG. 7 is a perspective view of the dice showing numbered sides as well as additionally colored sides for "sliding" and "stacking".

Each of the tile pieces has a bottom side, as seen in FIG. 6, having grooves 21 across two central axis forming a cross configuration and around a peripheral edge of the tile mating with the edges of the four playing spaces 26 of the top side so that the walls 24 of the top side of the tiles can fit within the identical to complement the top four square tiles 25, thus matching the sides of the playing spaces on the top side so that one tile may be stacked upon another tile with the walls 24 on the top side of a bottom tile piece fit within the grooves 21 on the bottom side of the top stacked tile piece, wherein the mating top and bottom configurations on the tiles permit stacking the tile pieces.

In FIGS. 1–4, the board game device preferably further comprises a support board 30 having physical row indicating means preferably comprising a series of parallel linear protrusions 31 across the board for demarking aligned rows capable of receiving a series of tile pieces in each of the aligned rows to form the playing board with the linear protrusions 31 of the support board 30 fitting within the grooves 21 on the bottom side of the tiles 20, the tile pieces being capable of sliding within each of the aligned rows on the support board.

In FIGS. 3 and 4, a rotatable board 35 having roller bearings or other "lazy Susan" type rotatable board is attached under the support board 30 to be able turn the playing board to different orientations so that each player in the player's turn may orient the playing board as desired.

The strategy game may also be represented in a visual display format programmed to simulate the strategy game, so that it can be played on a video game or the world wide web or similar media.

In practice, as a possible example the game could be played according to the following description, which is given by way of example, but in no way as a limitation of the game as claimed. The game contains a number of tiles preferably double the number if tiles used to set up the original board. In this example of a five by five tile board the game contains 50 maze tiles (with colored walls such as green walls) for a preferred 5×5 tile board, 4 special tiles (with differently indicated walls such as red walls), a random selection means such as 2 dice (with one slide and one stack face on each die or other random selection means), 4 or more sets of 5 or other number of playing pieces (which are differentiated from each other by some means such as colors, such as blue, red, green, yellow), 1 tile bag, and 1 equipment bag (for storage of the special tiles, playing pieces, and dice). Optional equipment may include a deluxe game board, which may be rotatable, and additional or alternative playing pieces in different colors.

The order of play is as follows. To get started in setting up the board:

1. Place all of the maze playing tiles (excluding the special tiles) in the tile bag.
2. Have each player select, out of the tile bag, an equal number of tiles so that the total number of selected tiles together is sufficient to create the playing board (five tiles each for a 5×5 tile playing board with four players or other number as desired depending on the number of players and desired size of the board) and set up the playing board with the tiles in rows (don't spend to much time working to set a path, because it will change!) Once a tile is placed it cannot be moved or turned.
3. After the rows of tiles are set to form the game board, replace the middle square with one of the special tiles. (We recommend playing with the "+")
4. Choose 3 of the same color playing pieces.
5. Roll the die or activate another random number selection means to see who goes first.

The highest number starts, then clockwise from there (the person to the left)

To Play:

1. Roll both dice or activate another random number selection means, add the numbers together and move one playing piece the correct number of spaces. Remember:

a. Moving on or off the board counts as one space.
b. An exact roll or random number selection is required to exit the board.
c. Move only one piece during any one turn
d. Move only left, right, up or down. Diagonal moves are not allowed.
e. Do not cross the same space twice in the same move (including the starting space)
f. Do not jump walls (beware of the walls that exist behind the tiles that are stacked, sometimes they are hard to see)
g. It is possible to add up to two tiles to the board in any one turn
h. If the final move of your playing piece lands on a space that is already occupied by another playing piece, then bump that piece back to its owner. (Even if it is your piece).
i. A playing piece must be moved the correct number of spaces before a "slide" or "stack" can be used. If not, the "slide" or "stack" is forfeited.
j. If a player does not have the ability to move any of their playing pieces for 3 consecutive turns (ie. The pieces are trapped), one of the playing pieces can return to the owners' entrance after the 3rd time.

2. For each "Slide" on the random selection means such as dice:

a. Select a tile from the tile bag and slide it on to the board. (You may add it from any of the sides of the board). Return the "pushed off" tile back to the bag.
b. Do not push a special tile or a tile with a playing piece off the board.

3. For each "Stack" on the random selection means such as dice:

a. Select a tile from the tile bag and place it on top of another tile on the board. You do not remove the previous tile.
b. Do not stack on top of a special tile or a tile with a playing piece.
c. Do not stack greater then three tiles high.

4. If there are no tiles left in the tile bag, "stack" and "slide" actions cannot be used.

To Win:

Be first to get all of your playing pieces from your entrance to your exit (the opposite side of the game board).

Special Maze Tiles (red)

There are 4 special maze tiles included in the present game. Each tile will increase the complexity of the game:

| Level | Tile Type |
|---|---|
| Beginner | No walls |
| Intermediate | Single Wall |
| Advance | Cross |
| Expert | Box |

Choose the tile that will allow the majority of the players to have a great time!

Playing Pieces

Depending on the skill of the players or the amount of time that is available to play the game of the present invention, you have the option of changing the number of playing pieces that are available to be in play:

| Skill Level | Time To Play | Number Of Pieces |
|---|---|---|
| Beginner | Short | 1–2 |
| Intermediate | Medium | 3 |
| Advance | Long | 4 |
| Expert | Long | 5 |

Strategy

Setting up the board:

Always give yourself a couple of entrances to the playing board—This will give you more opportunities to enter the board, and find an initial path to the other side.

When sliding or stacking maze tiles on the board create paths across the board—This will allow your playing pieces to be get on the board and start moving.

Keep a path going from your entrance to your exit.

While Playing:

Look forward two to three maze tiles, so your playing pieces always have a path to follow—This will allow your playing piece to always have someplace to go.

Look for opportunities to slide or stack a maze tile on to the board, that will either:

Create a path for your playing piece

Push your playing piece closer to the exit

Remove a path for your opponent(s), block your opponents, providing them with no path to move Push an opponents piece farther away from their exit Block an opponent's piece from their exit.

Try not to get multiple playing pieces on one maze tile.

Sometimes the best moves are not always forward. Look for paths that are on the sides and are going backwards.

Variations

The following variations are ideas that will make the game either easier, harder, or just different:

Play with a different number of playing pieces—one playing piece when you first start playing the game, two playing pieces when you begin to enjoy the game, three playing pieces when you play with strategy, four or five when you really want to make it a game.

Play with more than 4 players. Multiple players can use the same side entrance and exit.

Find items around the house to use as the other playing pieces.

Change the board size. 2×2, 3×3, 4×4 for an easier game 6×6 for a harder game (leaving only 14 maze tiles in the tile bag), or 7×7 for a really hard game (leaving only 1 maze tile in the tile bag). For games that are larger then 5×5 it might be wise not to use the stack rule (you will run out of tiles pretty quickly) or the deluxe game board (the tiles will not fit on the board).

For larger games, use two strategy game sets together (the more tiles, the more fun!) Change the Special tile to a move advance one. This will make the game harder, because several paths will not be available.

Use more then one special tile in a single game. This will make the game harder, because even more paths will not be available and fewer tiles can be pushed off the board or stacked upon.

Allow to "push-off" a maze tile that has a playing piece on. This will make the game very hard.

Allow more then 3 tiles to be stacked. This will make the game easier.

Treat all playing pieces as if they were walls. This will make the game harder, it would invalidate the rule that if a playing piece lands on another it would remove that playing piece back to their start.

Allow the "slide" or "stack" on the die or other random selection means to allow a playing piece to jump a wall or add a maze tile—This would make the game easier.

Allow a player to roll again after rolling the "slide" or "stack" on the die (regardless of any other rule changes). This will make the game easier by allowing a player to capitalize on the new board and harder for the other players.

Allow a player to roll again after rolling doubles on the random selection means such as dice. This will make the game easier by allowing the player to go again.

Add a rule that will force a player to forfeit their turn if they roll three "slide" or "stack" on the die in a row. This will make the game harder by not allowing a player to capitalize on the new board, or to be able to change the board again.

Have an opponent pre-set up the board with a complete maze, to see if you can solve it.

This is a whole different game.

After the first player wins, allow the rest of the player's to play for second and third (allow the player to come in forth to clean up).

Have each player pick up one maze tile from the bag, and place it on the board from their side of the board (edge). It is possible to "push" the maze tile on the board; this will cause at least one of the already existing maze tiles on the board to be pushed into a new position.

During this phase of the game, it will not be possible for a player to "push-off" another maze tile from the board.

Play a series of games. Play for points: 10 points for each playing piece to reach the exit, −10 point for each playing that fails to reach the exit, and 10 points for the winner).

After every roll of the die, add a new maze tile. This will not make the game any easier or harder . . . just different. If you play with this variation, you will need to in-validate the meaning of "slide" or "stack" die; just count it as either a 1 or a 2.

Do not stack or slide tiles; just change the direction of them or trade them for another tile. Set up the board as you would always; but each time you get a "slide" or "stack" on the die still move the required spaces but instead of adding a new tile; pick one tile and turn it or trade it for another. This will not make the game any harder or easier; because it is just a different type of game.

In the virtual version of the strategy game on an electronic medium all of the components are virtual images on a screen and the moves are made remotely by controls activating a program to carry out the moves and picture them on the screen.

It is understood that the preceding description is given merely by way of illustration and not in limitation of the invention and that various modifications may be made thereto without departing from the spirit of the invention as claimed.

What is claimed is:

1. A strategy game comprising:

a series of playing pieces with at least one playing piece having a distinguishing means for distinguishing the piece as exclusive to a player;

a series of tile pieces, each comprising at least one playing space for receiving at least one playing piece thereon and at least one potential barrier indicator on at least one side of the playing space indicating a barrier element across which a playing piece is not entitled to pass, the tile pieces capable of being manipulated to create a dynamic non-static playing board in a changeable maze configuration positioned on a horizontal surface, which maze configuration is changeable during play, the tile pieces capable of being evenly aligned in rows so that every tile piece in each row are capable of sliding relative to a stationary row, the tile pieces being capable of being positioned in a flat configuration at a beginning of a game to form the dynamic non-static playing board with playing spaces and barrier elements creating a maze configuration through which the playing pieces are capable of moving; wherein each tile piece has a groove at a bottom, at least one random selection means capable of indicating one of a series of numbers indicating, a number of spaces to be moved across the playing board on the playing spaces by a playing piece, the random selection means further comprising at least one slide indicator randomly appearing on a player's on a which slide indicator designates that the player slide a new tile piece into a first end of one row and thereby causing a tile piece at an opposite second end of the row to slide out of the row and be removed from the playing board, thereby altering the maze on the playing board.

2. The strategy game of claim 1, wherein the random selection means comprises at least one multi-sided die, each side of which die bear, a numerical indicator for indicating the number of playing spaces to be moved by a playing piece across the playing board.

3. The strategy game of claim 1, wherein the random selection means comprises an electronic selection means for generating random numbers.

4. The strategy game of claim 1, wherein the slide indicator comprises a visual indicator which may appear simultaneously with one of the series of numbers.

5. The strategy game of claim 1, wherein each of the tile pieces is capable of being stacked on any one of the other playing pieces and the indent selection means further comprising at least one stack indicator randomly appearing on a players turn which stack indicator designates that the player stacks new tile piece on one of the tile pieces on the playing board thereby potentially altering the maze configuration of the playing board.

6. The strategy game of claim 5, wherein the slide indicator comprises a visual indicator which may appear simultaneously with one of the series of numbers.

7. The strategy game of claim 5, wherein each of the tile pieces has a top side formed in a square plane having orthogonal bisecting indicia indicating four playing spaces evenly spaced around the tile piece and the at least one barrier indicator comprises at least one linear protrusion from the top side along at least one side of at least one of the playing spaces and each of the tile pieces has a bottom side having orthogonal bisecting linear grooves matching the sides of the playing spaces on the top side so that one tile may be stacked upon another tile with the barrier indicators of a bottom tile piece fitting in a groove on the bottom side of the top stacked tile piece.

8. The strategy game of claim 7, further comprising a support board having physical row indicating means comprising a series of parallel linear protrusions across the board for demarking aligned rows capable of receiving a series of tile pieces in each of the aligned rows to form the playing board with the linear protrusions of the support board fitting within the grooves on the bottom side of the tile, the tile pieces being capable of sliding within each of the aligned rows on the support board.

9. The strategy game of claim 1, further comprising a support board having physical row indicating means thereon for demarking aligned rows capable of receiving a series of tile pieces in each of the aligned rows to form the playing board, the row indicating means being capable of receiving a series of tile pieces therein, the tile pieces being capable of sliding within each of the aligned rows on the support board.

10. The strategy game of claim 9, further comprising a rotatable board under the support board to turn the playing board to different orientations.

11. The strategy game of claim 1, wherein the strategy game is represented in a visual display format programmed to simulate the strategy game.

12. A strategy game comprising:

a series of playing pieces with at least one playing piece having a distinguishing means for distinguishing the piece as exclusive to a player;

a series of tile pieces, eat defining four playing space quadrants therein for receiving at least one playing piece thereon and including at least one fixed barrier within an area defined by the four playing space quadrants across which a playing piece is not entitled to pass, the tile pieces capable of being manipulated to create a dynamic non-static playing board in a changeable maze configuration positioned on a horizontal surface, which maze configuration is changeable during play, the tile pieces capable of being evenly aligned in rows so that every tile piece in each row is capable of sliding relative to a stationary row, the tile pieces being capable of being positioned in a configuration at a beginning of a game to form the dynamic non-static playing board with playing spaces and barrier elements creating a maze configuration trough which the at least one playing piece is capable of moving; wherein each tile piece as groove at a bottom at least one random selection means capable of indicating one of a series of numbers indicating a number of spaces to be moved across the playing board on the playing spaces by a playing piece, the random selection means further comprising at least one slide indicator randomly appearing one a player's turn which slide indicator designates that the player slide a new tile piece into a first end of one row and thereby causing a tile piece at an opposite second end of the row to slide out of the row and be removed from the playing board, thereby altering the maze on the paying board.

13. The strategy game of claim 12, wherein each of the tile pieces is capable of being stacked on any one of the other playing pieces and the random selection means further comprising at least one stack indicator randomly appearing on a players turn which stack indicator designates that the player stack a new tile piece on one of the tile pieces on the playing board thereby potentially altering the maze configuration of the playing board.

14. The strategy game of claim 13, wherein each of the tile pieces has a top side formed in a square plane having orthogonal bisecting indicia indicating four playing spaces evenly spaced around the tile piece and the at least one fixed barrier comprises at least one linear protrusion from the top side along at least one side of at least one of the playing spaces and each of the tile pieces has a bottom side having orthogonal bisecting linear grooves matching the sides of the playing spaces on the top side so that one tile may be stacked upon another tile with the barrier indicators of a bottom tile piece fitting in a groove on the bottom side of the top stacked tile piece.

15. The strategy game of claim 14, further comprising a support board having physical row indicating means comprising a series of parallel linear protrusions across the board for demarking aligned rows capable of receiving a series of tile pieces in each of the aligned rows to form the playing board with the linear protrusions of the support board fitting within the grooves on the bottom side of the tiles, the tile pieces being capable of sliding within each of the aligned rows on the support board.

16. The strategy game of claim 12, wherein the strategy game is represented in a visual display format programmed to simulate the strategy game.

17. A strategy game comprising:

a series of tile pieces, each defining four playing space quadrants therein for receiving at least one playing piece thereon and including at least one fixed barrier within an area defined by the four playing space quadrants across which a playing piece is not entitled to pass, the tile pieces capable of being manipulated to create a dynamic non-static playing board in a changeable maze configuration positioned on a horizontal surface, which maze configuration is changeable during play, the tile pieces capable of being evenly aligned in rows so every tile piece in each row is capable of sliding relative to a stationary adjacent row, the tile pieces being capable of being positioned in a configuration at a beginning of a game to form the dynamic non-static playing board with playing spaces and barrier elements creating a maze configuration through which the at least one playing piece is capable of moving wherein each tile piece has a groove at a bottom.

18. The strategy game of claim 17, wherein each of the tile pieces is capable of being stacked on any one of the other playing pieces and the random selection means further comprising at least one stack indicator randomly appearing on a players turn which stack indicator designates that the player stack a new tile piece on one of the tile pieces on the playing board thereby potentially altering the maze configuration of the playing board.

19. The strategy game of claim 18, wherein each of the tile pieces has a top side formed in a square plane having orthogonal bisecting indicia indicating four playing spaces evenly spaced around the tile piece and the at least one fixed barrier comprises at least one linear protrusion from the top side along at least one side of at least one of the playing spaces and each of the tile pieces has a bottom side having orthogonal bisecting linear grooves matching the sides of the playing spaces on the top side so that one tile may be stacked upon another tile with the barrier indicators of a bottom tile piece fitting in a groove on the bottom side of the top stacked tile piece.

20. The strategy game of claim 17, wherein the strategy game is represented in a visual display format programmed to simulate the strategy game.

* * * * *